US010918147B2

(12) United States Patent
Cheema

(10) Patent No.: US 10,918,147 B2
(45) Date of Patent: Feb. 16, 2021

(54) LINING SYSTEM FOR ARTICLES OF CLOTHING

(71) Applicant: First Manufacturing Co., Oceanside, NY (US)

(72) Inventor: Ajmal Cheema, Syosset, NY (US)

(73) Assignee: First Manufacturing Co., Oceanside, NY (US)

( * ) Notice: Subject to any disclaimer, the term of this patent is extended or adjusted under 35 U.S.C. 154(b) by 74 days.

(21) Appl. No.: 15/599,014

(22) Filed: May 18, 2017

(65) Prior Publication Data

US 2018/0332912 A1 Nov. 22, 2018

(51) Int. Cl.
*A41D 27/04* (2006.01)

(52) U.S. Cl.
CPC ..... *A41D 27/04* (2013.01)

(58) Field of Classification Search
CPC ..... A41D 27/04
USPC ..... 2/DIG. 1, 97, 272, 85, 93, 108
See application file for complete search history.

(56) References Cited

U.S. PATENT DOCUMENTS

| | | | | |
|---|---|---|---|---|
| 3,514,788 | A | 6/1970 | Miller | |
| 4,475,251 | A | 10/1984 | Hopkins | |
| 4,608,715 | A | 9/1986 | Miller et al. | |
| 5,655,222 | A * | 8/1997 | Grilliot | A62B 17/003 2/272 |
| 6,199,210 | B1 * | 3/2001 | Feldman | A41D 3/00 2/108 |
| 6,961,962 | B1 | 11/2005 | Lewis | |
| 2002/0174476 | A1 | 11/2002 | Cochran | |
| 2004/0172734 | A1 * | 9/2004 | Hartbrodt | A41D 13/0012 2/97 |

* cited by examiner

*Primary Examiner* — Gloria M Hale
(74) *Attorney, Agent, or Firm* — Scully, Scott, Murphy & Presser, P.C.

(57) ABSTRACT

A lining system for articles of clothing is provided. The lining system enabling easy access to inward facing surfaces of outer panel portions of the article of clothing that incorporates the lining system. The lining system includes a plurality of detachable fasteners, each adapted to selectively move between a closed configuration and an open configuration providing access to the inward facing surfaces of the outer panel portion for applying patches thereto.

7 Claims, 1 Drawing Sheet

100
10
12
20
22
24
30
32
34
40
42
44
90
124
134
144

LINING SYSTEM FOR ARTICLES OF CLOTHING

BACKGROUND OF THE INVENTION

The present invention relates to articles of clothing and, more particularly, to a lining system for articles of clothing enabling easy access to inward facing portions of outer panels for applying patches thereto.

Desire to adorn an article of clothing with patches along the outward facing panels, at least for certain fabric material such as leather, requires access to the inward facing surface of the same panel. When the article of clothing has an inner lining, such access necessitates removing or at least separating a portion of the inner lining adjacent the inward facing surface of the portion of outer panel receiving the patch. Currently, this demands removing a portion of the threading, sewing, and/or other joining material that was originally used to join the lining to the outer panel in the first place, and then after utilizing the granted access to apply the patches the inner lining would need to be sewn back into the article of clothing. This would take hours for each such patch application.

As can be seen, there is a need for a lining system for articles of clothing enabling easy access the inward facing surfaces of its outer panels.

SUMMARY OF THE INVENTION

In one aspect of the present invention, a lining system for articles of clothing includes an article of clothing having left and right outer panels adapted to be worn by a human wearer; each outer panel having an outer surface and an inner surface; for each outer panel, a generally coextensive lining panel attached thereto so as to define a spaced apart relationship therebetween; a left front detachable fastener interconnecting the left outer panel and respective lining panel so as to define a left front opening communicating with a left front spaced apart relationship; and a right front detachable fastener attached between the right outer panel and respective lining panel so as to define a right front opening communicating with a right front spaced apart relationship, wherein each detachable fastener is movable between a closed configuration, closing off respective opening, and an open configuration providing access to the inner surface.

In another aspect of the present invention, the lining system for articles of clothing includes an article of clothing having left, right, and back outer panels adapted to be worn by a human wearer; each outer panel having an outer surface and an inner surface; for each outer panel, a generally coextensive lining panel attached thereto so as to define a spaced apart relationship therebetween; a back detachable fastener attached between the back outer panel and respective lining panel so as to define a back opening communicating with a back spaced apart relationship, wherein the back detachable fastener extends horizontally between the left outer panel and the right outer panel along and just inward of a lower periphery of the back outer panel; a left front detachable fastener interconnecting the left outer panel and respective lining panel so as to define a left front opening communicating with a left front spaced apart relationship; and a right front detachable fastener attached between the right outer panel and respective lining panel so as to define a right front opening communicating with a right front spaced apart relationship, wherein the left front detachable fastener extends vertically just inward of and along a distal periphery of the left outer panel, and wherein the right front detachable fastener extends vertically just inward of and along a distal periphery of the right outer panel, wherein the left, right, and back outer panels are adapted to be located adjacent the wearer's respective left front, right front, and back torso when said article of clothing is worn, and wherein each detachable fastener is movable between a closed configuration, closing off respective opening, and an open configuration providing access to the inner surface.

In another aspect of the present invention, a method for applying a patch along a predetermined portion of an outer panel of an article of clothing having the above-mentioned lining system includes the steps of: moving one of the left and right front detachable fastener most nearest said predetermined portion to the open configuration; accessing through the respective opening an inner surface of said outer panel disposed opposite the said predetermined portion; and applying the patch to said predetermined portion.

These and other features, aspects and advantages of the present invention will become better understood with reference to the following drawings, description and claims.

DETAILED DESCRIPTION OF THE INVENTION

Figures 1, 2:
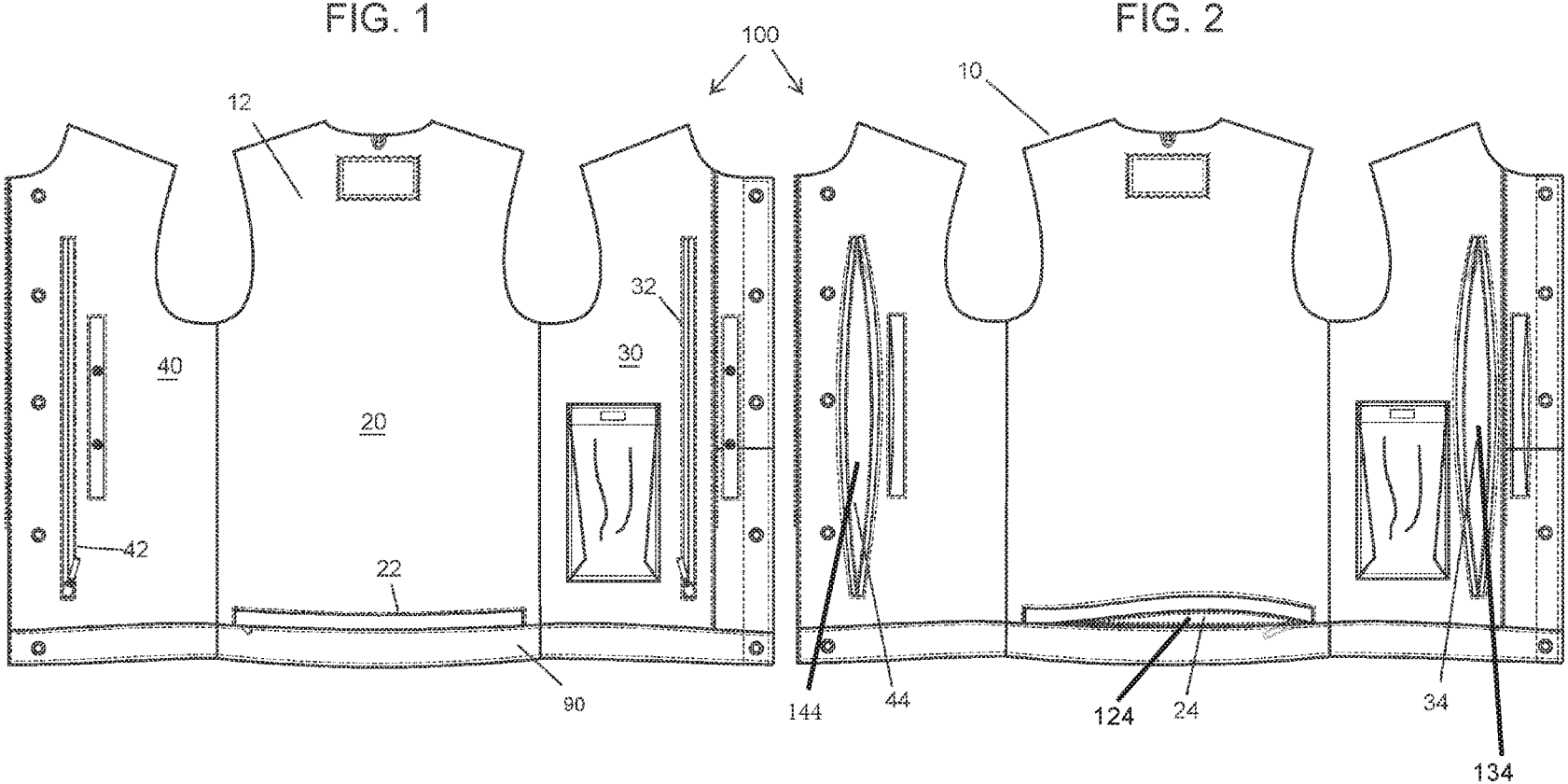
FIG. 1 is an elevational view of an exemplary embodiment of the present invention, demonstrating a closed configuration.
FIG. 2 is an elevation view of an exemplary embodiment of the present invention, demonstrating an open configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lining system for articles of clothing enabling easy access to inward facing surfaces of outer panel portions of the article of clothing that incorporates the lining system. The lining system includes a plurality of detachable fasteners, each adapted to selectively move between a closed configuration and an open configuration providing access to the inward facing surface for applying patches to the outer panel.

Referring to FIGS. 1 and 2, the present invention may include a lining system 100 for articles of clothing enabling easy access to inward facing surfaces of the outer panel portions of the article of clothing 10. The article of clothing 10 may be any article adapted to be worn by a human wearer. Though the illustrations depict an article to be worn about the upper body or torso of a human wearer, the articles of clothing contemplated by the present invention include articles adapted to be worn about the lower body, such as pants, worn about the upper body, such as a jacket or vest, or adapted to be worn over the entire (upper and lower) body of a human wearer, such as snowmobile suit, and the like. Each article of clothing 10 has at least one outer panel, providing an outward facing surface and an inner facing surface 90. The lining system 100 is adapted to removably attached along portions of a periphery or inward of portions the periphery of the inner facing surface 90, wherein the lining system 100 has a spaced apart relationship with its counterpart portion of inner facing surface 90.

In the context of upper body wear, as shown in the Figures, the lining system 100 provides a back lining panel 20 adapted to cover and/or be located adjacent to the back of the human wearer, a left front lining panel 30 adapted to cover and/or be located adjacent to the left front portion of their torso, and a right front lining panel 40 adapted to cover and/or be located adjacent to the right front portion of their torso when the article of clothing 10 is worn. In this case, the lining system 100 removably attaches to portions of the periphery of the inner facing surface 90 of the article of clothing 10 through a back detachable fastener 22, a left front detachable fastener 32, and a right front detachable fastener 42, respectively. Each detachable fastener may be adapted to be movable between a closed and an open configuration providing access to adjacent inner facing surface 90, but being inaccessible in the closed configuration. In the closed configuration, the lining system 100 provides the additional layer of comfort and warmth conventional lining provides.

The back detachable fastener 22 may extend horizontally between the left front lining panel 30 and the right front lining panel 40 along or just inward of a lower periphery of the back lining panel 20. The left front detachable fastener 32 may extend vertically along the left front lining panel 30 between lower and upper peripheries thereof, and at or just inward of a left-most (or distal) periphery thereof. The right front detachable fastener 42 may extend vertically along the right front lining panel 40 between lower and upper peripheries thereof, and at or just inward of a right-most (or distal) periphery thereof.

Each detachable fastener may be a zipper mechanism or the like that provides an attachment segment between an inner facing surface 90 of an outer panel and the detachable fastener's respective lining panel, resulting in a spaced apart relationship between lining panel and a generally coextensive portion of inner facing surface 90. Such spaced apart relationship or cavities may be further defined by threading, sewing or other joining elements between the lining panel and cooperating outer panels, for example along peripheral portions of said lining panel. Each detachable fastener (or attachment segment) removably attaches an access opening communicating, in the open configuration, to a respective spaced apart relationship/cavity: i.e., the back detachable fastener 22 selectively controls access to a back inner surface 24 of the back outer panel 124; the left front detachable fastener 32 selectively controls access to a left front inner surface 34 of the left outer panel 134; and the right front detachable fastener 42 selectively controls access to a right front inner surface 44 of the right outer panel 144.

It should be understood by those skilled in the art that the use of directional terms such as upper, lower, upward, horizontally, vertically, left, right, outer, inner, and the like are used in relation to the illustrative embodiments as they are depicted in the figures, the upward direction (or upper) being toward the top of the corresponding figures and a downward direction being toward the bottom of the corresponding figure.

A method of using the present invention may include the following. The lining system 100 disclosed above may be provided on an article of clothing 10 adapted to be worn on the torso of a human wearer. A user may selectively access one or all of the back, left front, and right front inner surfaces 24, 34 and 44 depending on which portion of the outer panel they want to dispose outward facing patches thereon.

It should be understood, of course, that the foregoing relates to exemplary embodiments of the invention and that modifications may be made without departing from the spirit and scope of the invention as set forth in the following claims.

What is claimed is:

1. A lining system for articles of clothing, comprising:

an article of clothing comprising left and right outer panels adapted to be worn by a human wearer;

each outer panel having an inner surface;

for each outer panel, a generally coextensive lining panel attached thereto so as to define a spaced apart relationship therebetween;

a left front detachable fastener configured to define a left front opening communicating with a left front spaced apart relationship;

a right front detachable fastener configured to define a right front opening communicating with a right front spaced apart relationship; and a back outer panel adapted to be worn by a human wearer; and further comprising a back detachable fastener configured to define a back opening communicating with a back spaced apart relationship, wherein each detachable fastener is movable between a closed configuration, closing off respective opening, and an open configuration providing access to the inner surface, and wherein a length of each of the left front detachable fastener and the right front detachable fastener is longer than a length of the back detachable fastener.

2. The lining system of claim 1, wherein the left and right outer panels are adapted to be located adjacent the wearer's respective left and right front torso when said article of clothing is worn.

3. The lining system of claim 1, wherein the back outer panel is adapted to be located adjacent the wearer's back when said article of clothing is worn.

4. The lining system of claim 1, wherein the left front detachable fastener extends vertically just inward of and along a distal periphery of the left front lining panel, and wherein the right front detachable fastener extends vertically just inward of and along a distal periphery of the right front lining panel.

5. The lining system of claim 1, wherein the back detachable fastener extends horizontally between the left outer panel and the right outer panel along and just inward of a lower periphery of the back lining panel.

6. A lining system for articles of clothing, comprising:

an article of clothing comprising left, right, and back outer panels adapted to be worn by a human wearer;

each outer panel having an inner surface;

for each outer panel, a generally coextensive lining panel attached thereto so as to define a spaced apart relationship therebetween;

a back detachable fastener configured to define a back opening communicating with a back spaced apart relationship, wherein the back detachable fastener extends horizontally between the left outer panel and the right outer panel along and just inward of a lower periphery of the back lining panel;

a left front detachable fastener configured to define a left front opening communicating with a left front spaced apart relationship; and a right front detachable fastener configured to define a right front opening communicating with a right front spaced apart relationship, wherein the left front detachable fastener extends vertically just inward of and along a distal periphery of the left front lining panel, and wherein the right front detachable fastener extends vertically just inward of and along a distal periphery of the right front lining panel, wherein the left, right, and back outer panels are adapted to be located adjacent the wearer's respective left front, right front, and back torso when said article of clothing is worn, wherein each detachable fastener is movable between a closed configuration, closing off respective opening, and an open configuration providing access to the inner surface, and wherein a length of each of the left front detachable fastener and the right front detachable fastener is longer than a length of the back detachable fastener.

7. A method for applying a patch along a predetermined portion of an outer panel of an article of clothing having a lining system of claim 1, comprising the steps of:

moving one of the left and right front detachable fastener to the open configuration;

accessing through the respective opening an inner surface of said outer panel disposed opposite the said predetermined portion; and applying the patch to said predetermined portion.

* * * * *